US009061306B2

(12) United States Patent
Behar

(10) Patent No.: US 9,061,306 B2
(45) Date of Patent: Jun. 23, 2015

(54) DEVICE FOR DISPENSING A FLUID PRODUCT

(75) Inventor: Alain Behar, Suresnes (FR)

(73) Assignee: APTAR FRANCE SAS, Le Neubourg (FR)

( * ) Notice: Subject to any disclaimer, the term of this patent is extended or adjusted under 35 U.S.C. 154(b) by 446 days.

(21) Appl. No.: 13/061,665

(22) PCT Filed: Sep. 1, 2009

(86) PCT No.: PCT/FR2009/051656

§ 371 (c)(1),
(2), (4) Date: Mar. 1, 2011

(87) PCT Pub. No.: WO2010/026338

PCT Pub. Date: Mar. 11, 2010

(65) Prior Publication Data

US 2011/0186651 A1 Aug. 4, 2011

(30) Foreign Application Priority Data

Sep. 4, 2008 (FR) ..... 08 55944

(51) Int. Cl.
*B05B 11/00* (2006.01)
*B05B 11/06* (2006.01)

(52) U.S. Cl.
CPC ..... *B05B 11/0064* (2013.01); *B05B 11/007* (2013.01); *B05B 11/061* (2013.01); *B05B 11/3049* (2013.01)

(58) Field of Classification Search
CPC ..... B05B 11/007; B05B 11/061; B05B 11/30496
USPC ..... 239/330, 318, 434, 569, 410, 411, 239/416.2, 337, 302
See application file for complete search history.

(56) References Cited

U.S. PATENT DOCUMENTS

| | | | | |
|---|---|---|---|---|
| 4,880,161 | A * | 11/1989 | Wright | 239/330 |
| 7,080,761 | B1 * | 7/2006 | Yu | 222/633 |
| 2003/0071136 | A1 * | 4/2003 | Ference | 239/33 |
| 2008/0223879 | A1 * | 9/2008 | Batinkoff et al. | 222/207 |
| 2010/0252656 | A1 * | 10/2010 | Gerbron et al. | 239/318 |

FOREIGN PATENT DOCUMENTS

| | | | |
|---|---|---|---|
| AT | 0007 802 | U2 | 9/2005 |
| FR | 2 912 670 | A1 | 8/2008 |
| GB | 2 431 367 | A | 4/2007 |

* cited by examiner

*Primary Examiner* — Justin Jonaitis
(74) *Attorney, Agent, or Firm* — Sughrue Mion, PLLC

(57) ABSTRACT

A fluid dispenser device comprising: a fluid dispenser orifice (31); an air duct (32, 51, 52) for air under pressure, said air duct including an upstream end and a downstream end that opens out in the proximity of the orifice (31); an air expeller (4) that is suitable for being subjected to elastic squeezing and relaxation stages, the air expeller (4) being connected to the air duct (32, 51, 52) so that, during elastic squeezing stages, it delivers a flow of air through the air duct until it reaches the orifice (31); and a fluid channel (25, 33) that is connected to the air duct (32, 51, 52), the fluid in the channel (25, 33) being sucked up by the flow of air under pressure by the Venturi effect; the device being characterized in that the air expeller (4) has only a single opening (43) that is provided with a connection sleeve (5) that includes an incoming-air passage (53) that is provided with an air-inlet valve (56; 56*b;* 56*c;* 56*d*) that is suitable for allowing outside air to enter into the air expeller during elastic relaxation stages.

12 Claims, 4 Drawing Sheets

DEVICE FOR DISPENSING A FLUID PRODUCT

CROSS REFERENCE TO RELATED APPLICATIONS

Figure 1:
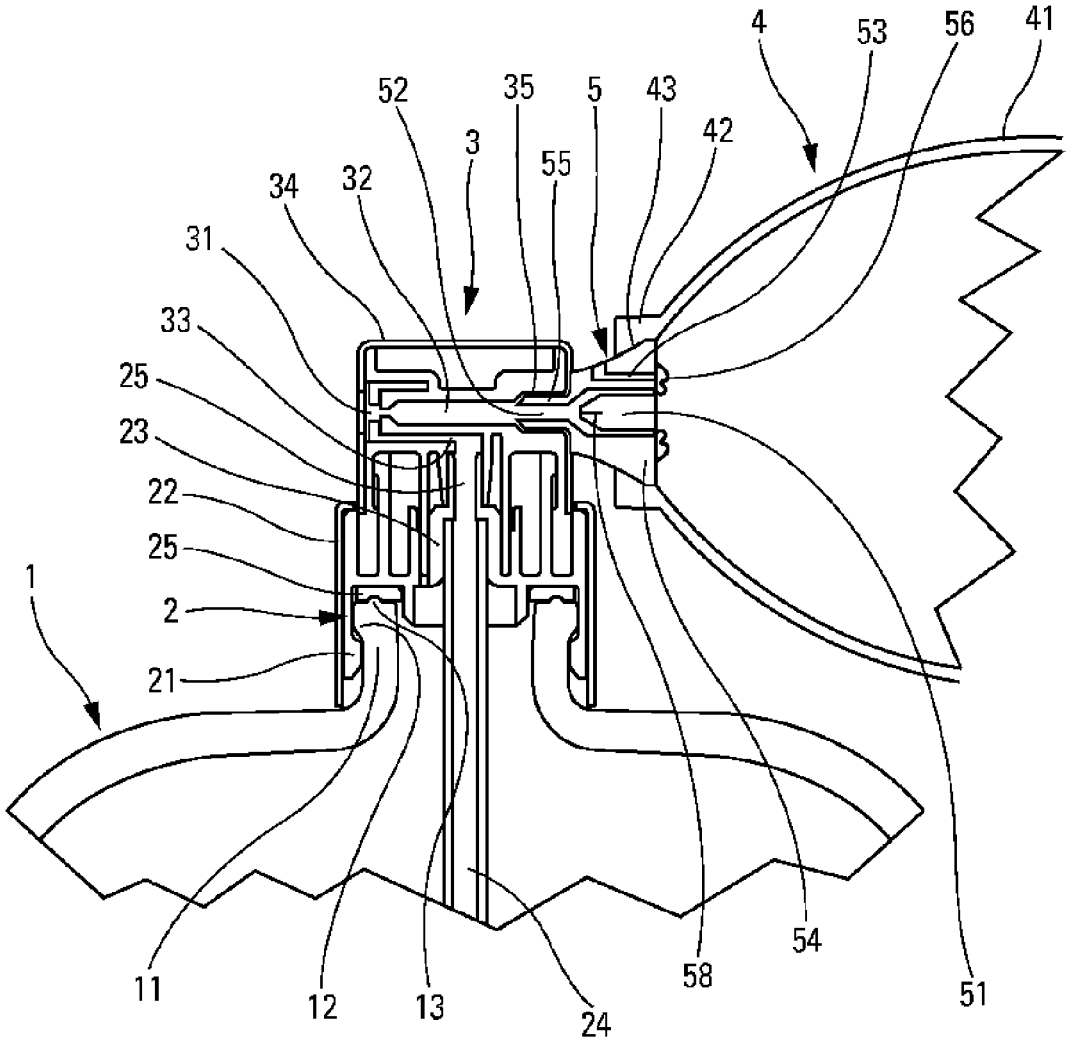

This application is a National Stage of International Application No. PCT/FR2009/051656 filed Sep. 1, 2009, claiming priority based on French Patent Application No. 08 55944 filed Sep. 4, 2008, the contents of all of which are incorporated herein by reference in their entirety.

The present invention relates to a fluid dispenser device for associating with a fluid reservoir, thereby forming a fluid dispenser. When the fluid is sprayed in the form of fine droplets, the dispenser itself is often designated by the term "spray". The advantageous field of application of the present invention is the field of perfumery or of cosmetics, but naturally it may apply to other fields in which it is necessary to dispense a fluid.

The dispenser device of the invention is of a particular type that provides mixed or two-phase dispensing of the fluid with a propellant gas, conventionally air. Thus, the dispenser device generally includes a fluid dispenser orifice via which the mixture of fluid and air is dispensed in the form of spray. The device also includes an air duct for air under pressure, said air duct having a downstream end that opens out in the proximity of the dispenser orifice, and an air expeller, such as a squeezable flexible bulb, that is connected to an upstream end of the air duct for delivering a flow of air under pressure through the air duct until it reaches the dispenser orifice. The device also includes a fluid channel that is connected to the air duct in the proximity of, or at, its downstream end, the fluid in the channel being sucked up by the flow of air under pressure by the Venturi effect, in such a manner as to dispense a mixture of air and fluid through the dispenser orifice. That type of dispenser device is often designated by the term "bulb pump" that comes from the use of an air expeller in the form of a squeezable flexible bulb. That type of dispenser device has been known for a long time, and nowadays imparts a conventional or retro effect to the fluid dispenser. Such a dispenser is used by holding the reservoir in one hand, and by squeezing the bulb with the other hand. The dispenser orifice is secured to the reservoir, such that it is the hand holding the reservoir that directs the dispenser orifice and thus the jet of sprayed fluid. In that type of dispenser device, the air and fluid are mixed in the proximity of the dispenser orifice, or a little upstream from said dispenser orifice. By squeezing the flexible bulb, air is caused to flow under pressure through the air duct towards the dispenser orifice. That flow of air causes suction to be created inside the fluid channel that is generally connected to the reservoir via a dip tube. Consequently, the fluid present in the fluid channel is sucked up by the flow of air under pressure by a well known Venturi-effect phenomenon. Thus, fluid coming from the channel is introduced into the flow of air leaving the air duct. The fluid mixes with the flow of air, and the mixture obtained in this way is expelled through the dispenser orifice in the form of fine droplets of fluid.

The actuation of the air expeller (bulb) may thus be divided into two stages, namely an elastic squeezing stage and an elastic relaxation stage. During the squeezing stage, the working volume of the expeller is reduced, such that the air that it contains is put under pressure and flows through an opening towards the air duct. During the relaxation stage, the working volume of the expeller increases under the effect of the elastic memory of the expeller, and outside air thus penetrates into the expeller. Conventionally, the air expeller includes one end in which there is formed the opening that is connected to the air duct, and an opposite other end in which there is provided an air-inlet valve that is open during elastic relaxation stages and closed during elastic squeezing stages. Consequently, a conventional expeller includes two distinct and separate openings, and this firstly complicates the manufacture and assembly of the air expeller, and secondly degrades the attractiveness of its overall appearance.

An object of the present invention is to remedy the above-mentioned drawback of the prior art by defining a fluid dispenser device of the "bulb pump" type having an air expeller that is simpler to manufacture and that is more pleasing in appearance.

To do this, the present invention proposes a fluid dispenser device for associating with a fluid reservoir so as to form a fluid dispenser, the device comprising:

- a fluid dispenser orifice;
- an air duct for air under pressure, said air duct including an upstream end and a downstream end that opens out in the proximity of the orifice;
- an air expeller, such as a flexible bulb, that is suitable for being subjected to elastic squeezing and relaxation stages, the air expeller being connected to the upstream end of the air duct so that, during elastic squeezing stages, it delivers a flow of air under pressure through the air duct until it reaches the orifice;
- a fluid channel that is connected to the air duct in the proximity of its downstream end, the fluid in the channel being sucked up by the flow of air under pressure by the Venturi effect, in such a manner as to dispense a mixture of air and fluid through the dispenser orifice;

the device being characterized in that the air expeller has only a single opening that is provided with a connection sleeve that defines at least one portion of the air duct, the sleeve further including an incoming-air passage that is provided with an air-inlet valve that is suitable for allowing outside air to enter into the air expeller during elastic relaxation stages, and for preventing air from leaving the air expeller through the passage during elastic squeezing stages. In other words, the air-inlet valve has been moved from one end of the air expeller to the other end, where the opening is formed that is provided with the connection sleeve. An opening is thus eliminated from the air expeller that thus includes only a single opening. Air expellers may thus be made with a wide range of shapes, given that it is no longer necessary to provide a specific opening for the air-inlet valve.

According to an advantageous characteristic, the air-inlet valve may co-operate with a valve seat in such a manner as to bear against its seat during elastic squeezing stages, the air-inlet valve being disposed in such a manner as to be urged against its seat by the flow of air under pressure generated during elastic squeezing stages. Advantageously, the air-inlet valve is disposed at the center of the opening, and the flow of air under pressure that flows towards the air duct is directed to the air-inlet valve, the flow of air under pressure then passing around the valve. In a variant, the air-inlet valve is disposed around the flow of air under pressure. In one way or another, the air-inlet valve is caused to bear in leaktight manner against its seat during elastic squeezing stages.

According to another advantageous characteristic of the invention, the connection sleeve may also include a check valve that prevents fluid from being sucked through the air duct and into the expeller during elastic relaxing stages. Advantageously, the check valve co-operates with a valve seat in such a manner as to bear against its seat during elastic relaxation stages. In a variant, the check valve comprises a self-sealing slot that opens under the pressure of the flow of air generated during elastic squeezing stages, and that closes hermetically during elastic relaxation stages. In a variant, the air-inlet valve and the check valve are constrained to move together. Advantageously, the air-inlet valve and the self-sealing slot are made as a single valve member, and are made out of a single material or by bi-injection of two different materials. In a practical embodiment, the valve member comprises a fastener bushing that is substantially rigid and that is provided at one end with a dome that is formed with the self-sealing slot, and at the other end with a flexible annular membrane that extends outwards and that serves as an air-inlet valve.

A principle of the invention is to group together the flows of air leaving and/or entering the expeller at a single opening that is provided with a connection sleeve for connecting the expeller to the remainder of the dispenser device. The connection sleeve includes an air-inlet valve and/or a check valve.

The invention is described more fully below with reference to the accompanying drawings which show several embodiments of the invention by way of non-limiting example.

Figure 2A:
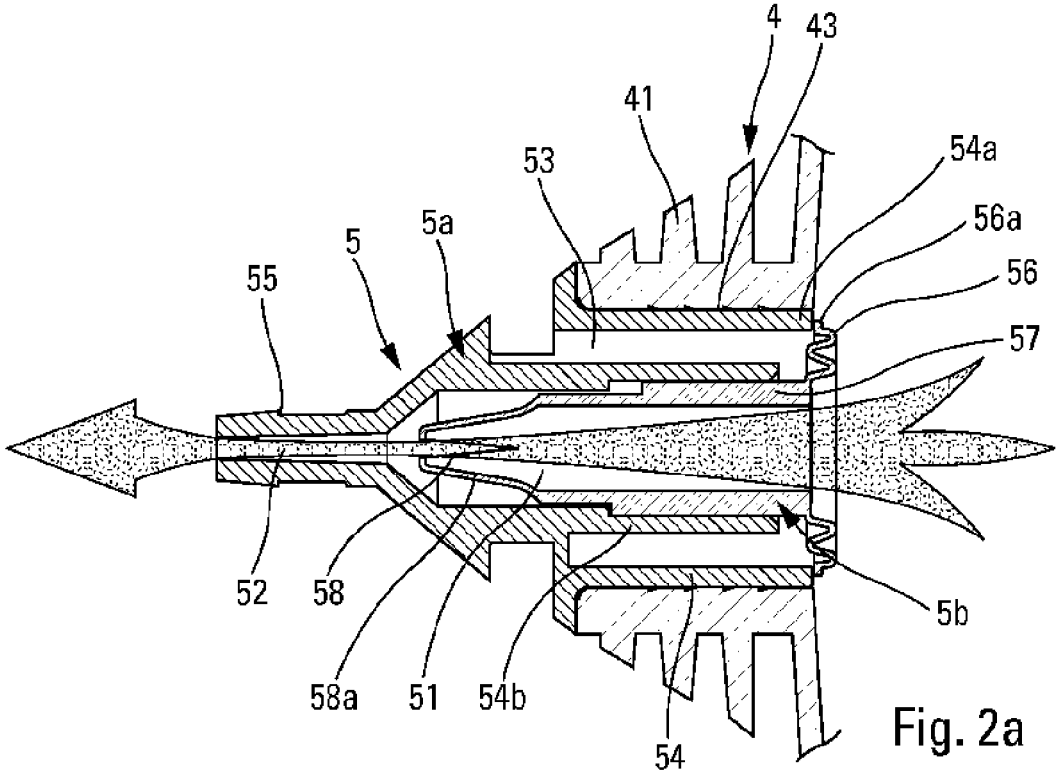
Figure 2B:
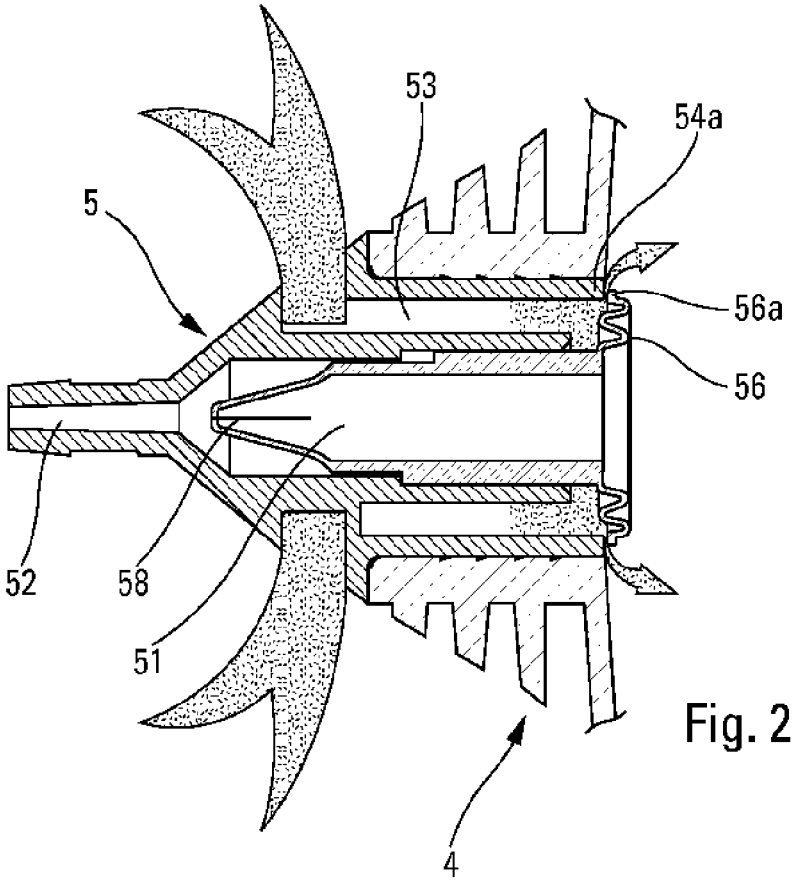
Figure 3:
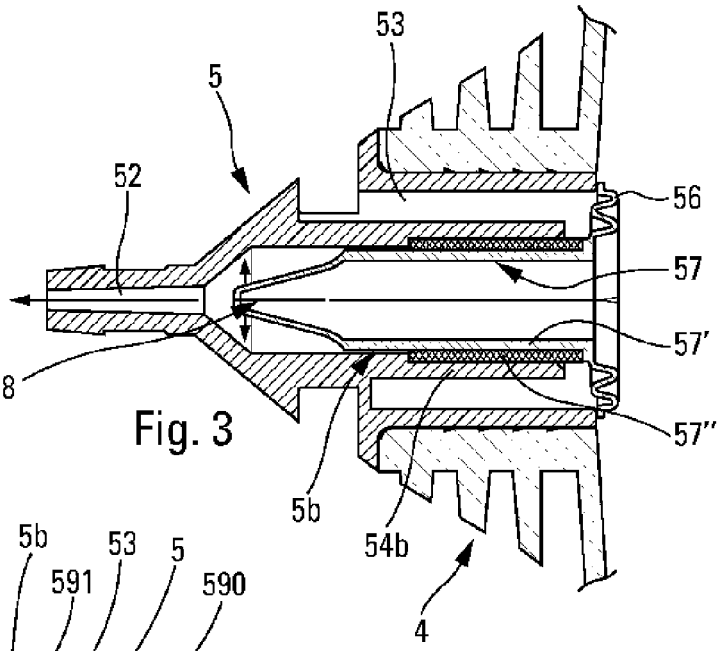
Figure 4A:
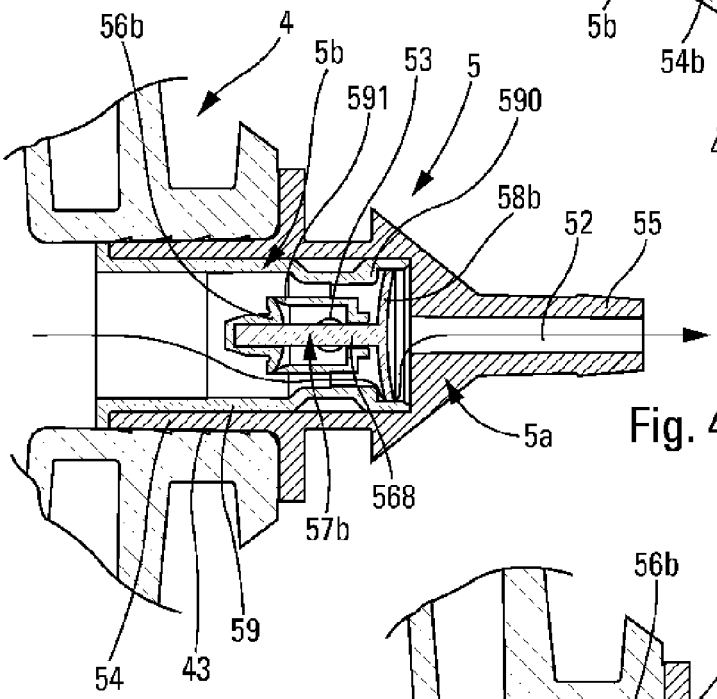
Figure 4B:
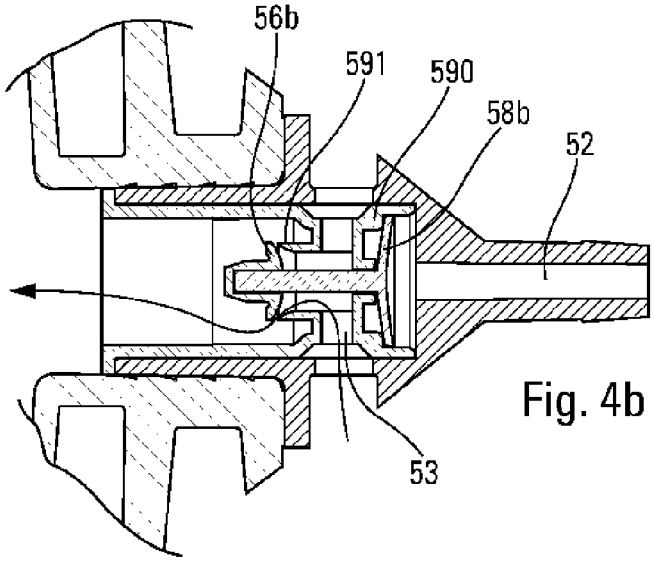
Figure 5:
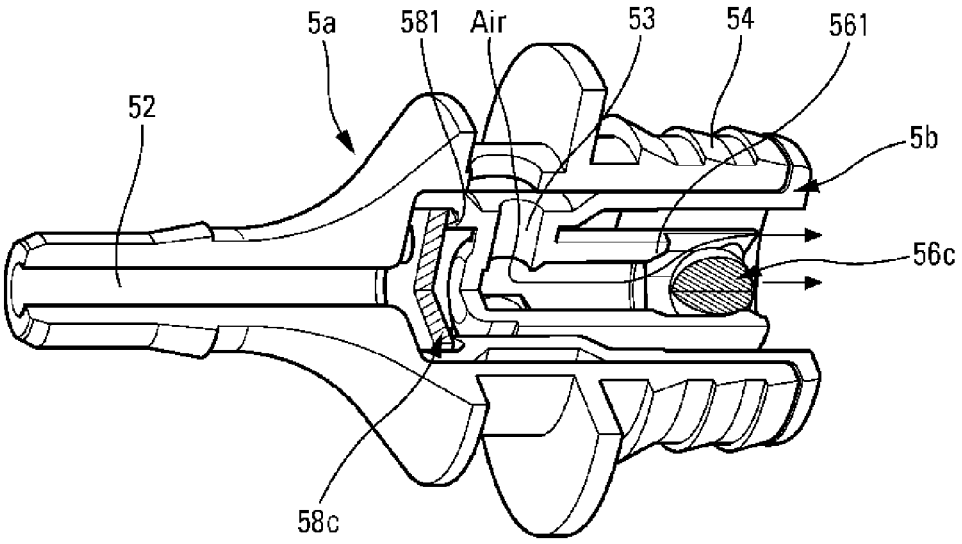
Figure 6:
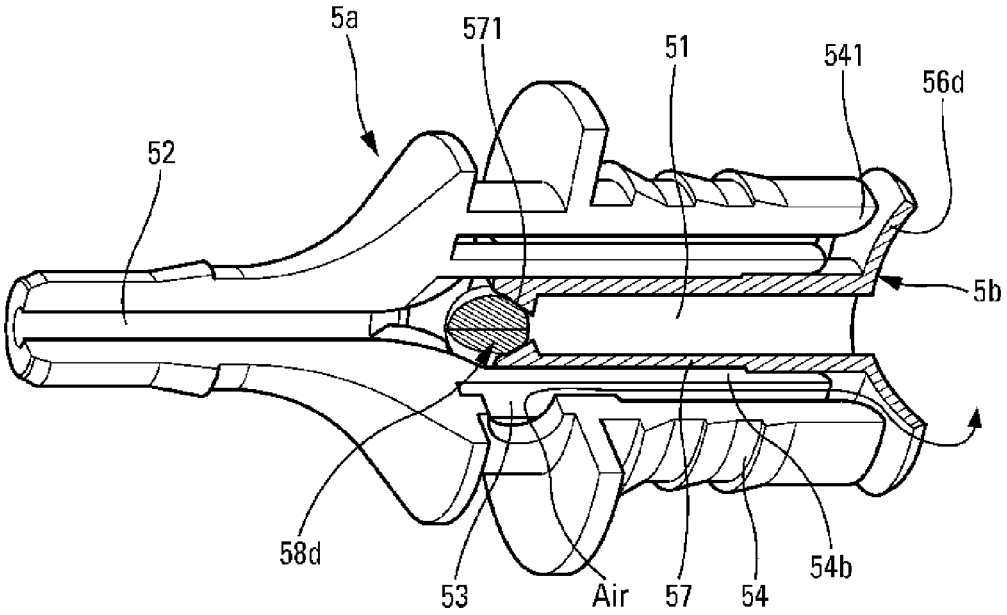

In the figures:

FIG. 1 is a vertical section view through a dispenser device in a first embodiment of the invention, mounted on a reservoir;

FIGS. 2*a* and 2*b* are larger-scale vertical cross-section views of the FIG. 1 connection sleeve, during a squeezing stage and a relaxation stage respectively;

FIG. 3 is a view similar to FIGS. 2*a* and 2*b* for a variant of the first embodiment;

FIGS. 4*a* and 4*b* are views similar to FIGS. 2*a*, 2*b*, and 3 for a second embodiment of a connection sleeve of the invention;

FIG. 5 is a larger-scale and cut-away perspective view of a connection sleeve in a third embodiment of the invention, during an elastic relaxation stage; and FIG. 6 is a view similar to the view in FIG. 5 for a fourth embodiment of the invention.

The fluid dispenser device of the invention shown in FIG. 1 essentially comprises four component elements, namely: a body 2; a head 3; an air expeller 4; and a connection sleeve 5. The device may further comprise other optional or accessory component elements, such as a covering hoop 22, a neck gasket 25, and/or a covering cap 34.

The dispenser device is for mounting on a neck 11 of a reservoir 1 containing the fluid to be dispensed. The fluid may typically be a fragrance or a sprayable cosmetic. The reservoir 1 may be made with any type of appropriate material and may present a certain rigidity. The neck 11 typically projects upwards in such a manner as to define a top annular edge 13. The neck 11 may also form an outer annular reinforcement 12 that is used for fastening the dispenser device of the invention. These characteristics are entirely conventional for a fluid reservoir in the fields of perfumery and/or cosmetics.

The body 2 of the dispenser device of the invention includes fastener means that make it possible to fasten the device on the neck 11 of the reservoir 1. In the example used to illustrate the present invention, the body 2 includes a skirt 21 that is capable of being fastened below the annular reinforcement 12 of the neck 11. The engagement of the skirt 21 below the reinforcement 12 further makes it possible to flatten the neck gasket 25 on the top edge 13 of the neck. In order to fasten the skirt 21 in stable manner around the neck 11, a covering hoop 22 may be provided that surrounds the outside of the skirt 21 and that masks the body 2 at least in part. The covering hoop 22 is preferably made of metal.

The body 2 also forms an inlet tube 23 in which there is engaged the top end of a dip tube 24 that extends inside the reservoir 1 until it reaches the proximity of its bottom wall (not shown). The tube 23 extends downstream from the end of the dip tube 24, in such a manner as to form a first portion 25 of a fluid channel. The body 2 also forms other elements that are not however critical for the present invention.

The head 3 is mounted on the body 2 in such a manner as to extend the first channel portion 25 in the form of a second channel portion 33 that communicates with a dispenser orifice 31 where the fluid and the air are mixed together as described below. The head 3 may be mounted in stationary manner on the body 2: in a variant, the head 3 may be mounted with the possibility of moving axially and/or pivotally relative to the body 2, e.g. in order to perform a function of closing the fluid channel 25, 33. This movement of the head 3 relative to the body 2 may also be used to perform a function of closing a vent hole (not shown), enabling outside air to penetrate into the reservoir 1 as the fluid is extracted therefrom through the dispenser device of the invention.

The head 3 also forms an air-duct portion 32 that presents a downstream end that communicates directly with the dispenser orifice 31. Thus, the fluid coming from the channel 25, 33, and the air under pressure coming from the duct 32, mix together at the orifice 31, and the mixture is expelled under the pressure of the air in the form of fine droplets of fluid. Optionally, the head 3 may be provided with a covering cap 34 that may advantageously be made of metal. The covering cap 34 is provided with a hole at the dispenser orifice 31. In diametrally-opposite manner, the cap 34 presents another hole for inserting the connection sleeve 5, as described below. To this end, at its upstream end, the air-duct portion 32 is formed with a connection housing 35 for the connection sleeve 5.

The air expeller 4 comprises a bulb 41 that is made with an elastic material that possesses shape memory. In conventional manner, the bulb 41 may present a pear or egg shape. In the invention, the bulb 41 includes a single opening 43 that is defined by an edge 42, advantageously a reinforced edge. The bulb 41 is suitable for being subjected to the repeated stages of elastic squeezing and of elastic relaxation. During squeezing stages, the air contained inside the bulb 41 is put under pressure and flows through its opening 43. During elastic relaxation stages, outside air penetrates into the bulb 41 through it single opening 43.

The connection sleeve 5 is mounted in the opening 43 of the bulb 41 and preferably is secured in permanent manner to the bulb. The sleeve 5 closes the opening 43 in part, defining however one or more outgoing-air duct portions 51, 52, and an incoming-air passage 53. The passage 53 is provided with an air-inlet valve 56 that is capable of allowing outside air to enter into the air expeller 4 during elastic relaxation stages, and of preventing air from leaving the air expeller through said passage 53 during elastic squeezing stages. For its connection to the head 3, the sleeve 5 includes an engagement endpiece 55 that is adapted to engage in leaktight manner inside the connection housing 35 formed by the head 3. Thus, the air-duct portion 51, 52 formed by the sleeve 5 may communicate directly with the duct portion 32 formed by the head 3. By squeezing the bulb 41, the air that it contains is expelled through the air duct portions 51, 52 and 32 so as to reach the dispenser orifice 31 where the air under pressure is mixed with the fluid coming from the channel 25, 33. During elastic relaxation stages, outside air may penetrate into the expeller 4 through the passage 53 having an air-inlet valve 56 that opens as a result of the suction generated inside the expeller. The air-duct portion 51, 52 may advantageously be provided with a check valve 58, as described below with reference to FIGS. 2*a* and 2*b*.

FIGS. 2*a* and 2*b* show, in larger-scale manner, embodiment details of the connection sleeve 5 used in the first embodiment in FIG. 1. FIG. 2*a* shows the sleeve during an elastic squeezing stage, whereas FIG. 2*b* shows the same sleeve 5 during an elastic relaxation stage. The outgoing and incoming flows of air are represented by arrows in the figures. The connection sleeve 5 includes a base body 5*a* to which there is associated a valve member 5*b*.

The base body 5*a* may be made as a single piece from an appropriate plastics material that presents a certain rigidity. The base body 5*a* includes an outer bushing 54 that is engaged in leaktight manner inside the opening 43 of the bulb 41. The fastening and/or sealing between the bulb 41 and the bushing 54 may be obtained by any appropriate means, such as by a tight fit, by snap-fastening, by barbs, by adhesive, by heat-sealing, by over-molding, by bi-injection, etc. The outer bushing 54 internally includes an inner bushing 54*b* that extends in concentric and coaxial manner inside the outer bushing 54. The inner bushing 54*b* is used as a support for the valve member 5*b*, as described below. In the invention, an air passage 53 is formed between the outer and inner bushings 54 and 54*b*. At its downstream end, the incoming-air passage 53 includes a valve seat 54*a* that is formed by the outer bushing 54. In addition, the inner bushing 54*b* extends so as to form the connection endpiece 55 that internally defines a portion 52 of the air duct for air under pressure.

In this embodiment, the valve member 5*b* includes a fastener section 57 that presents a substantially-cylindrical configuration. The fastener section 57 is engaged, e.g. by being clamped, inside the inner bushing 54*b*. The fastener section 57 is hollow and internally defines a portion 51 of the air duct for air under pressure. At one of its ends, the fastener section 57 forms a flexible dome 58*a* that is provided with a self-sealing slot 58. A self-sealing slot is a slot having edges that are touching and sealed in the rest condition. In contrast, the edges move apart so as to define an opening when they are subjected to sufficient pressure. The slot 58 makes it possible to separate the two air-duct portions 51, 52. In other words, when the slot is closed or sealed, the portion 51 cannot communicate with the portion 52. The dome 58*a* is disposed so that its slot 58 opens only when air under pressure comes from the portion 51. When air under pressure comes from the portion 52, the slot 58 remains closed in sealed manner. Thus, the slot 58 constitutes a check valve in the sense that it prevents any air from being let into the expeller 4 during elastic relaxation stages. This is shown in FIG. 2*b*. In contrast, the slot 58 opens wide so as to allow the air from the expeller to pass during elastic squeezing stages. This is shown in FIG. 2*a*. The valve member 5*b* also forms an air-inlet valve 56 in the form of an annular diaphragm that extends outwards from an end of the fastener section 57 that is opposite the end with the dome 58*a*. The free outer periphery 56*a* of the diaphragm bears selectively in leaktight manner against the seat 54*a* formed by the outer bushing 54. The diaphragm 56 thus closes the downstream end of the air passage 53. As a result of its disposition inside the expeller 4, the air-inlet valve 56 is pressed against its seat 54*a* during elastic squeezing stages (FIG. 2*a*), and lifts off its seat during elastic relaxation stages (FIG. 2*b*), so as to allow outside air to penetrate into the expeller through the air passage 53.

It should also be observed that the air-inlet valve 56 is formed around the air-duct portion 51 and is thus subjected to the pressure generated by the flow of air, in such a manner as to press its outer periphery 56*a* in leaktight manner against its seat 54*a*. Thus, the flow of air under pressure generated by the expeller is used to seal the air-inlet valve properly during elastic squeezing stages. In contrast, during elastic relaxation stages, the self-sealing slot 58 is kept closed by the suction that exists inside the expeller, and the outside air is thus sucked through the air passage 53 and into the expeller, forcing the air-inlet valve 56 into its open position.

Instead of the diaphragm valve 56, it is also possible to use a flap valve comprising one or more of flaps that are adapted to close corresponding through holes. The flaps may be cut out of a substantially rigid annular flange having the shape of the diaphragm 56.

It should also be observed that the valve member 5*b* may be made as a single piece with a single plastics material: the characteristics of rigidity and of deformability being provided merely by variations in wall thickness. It should be observed in FIGS. 2*a* and 2*b* that the fastener section 57 presents a wall thickness that is much thicker than the thickness of the dome 58*a* or of the diaphragm 56. In a variant shown in FIG. 3, the valve member 5*b* may be made with a fastener section 57 that is formed of two portions 57' and 57" that may advantageously be over-molded or bi-injected. The portion 57' may be made of a flexible plastics material, while the portion 57" is made of a rigid plastics material that imparts to the assembly, sufficient rigidity to fasten the valve member 5*b* in stable manner in the inner bushing 54*b*.

FIGS. 4*a* and 4*b* show a connection sleeve 5 in a second embodiment of the invention. This sleeve also includes a base body 5*a* and a valve member 5*b*. Just as in the above-described embodiment, the connection sleeve 5 is mounted in secure, leaktight, and advantageously permanent manner in the opening 43 of the air expeller 4. To do this, the sleeve 5 includes an outer bushing 54 that may advantageously be provided with fastener notches in the form of barbs. The base body 5*a* also forms a connection endpiece 55 for inserting in the corresponding housing 35 of the head. The endpiece 55 internally forms an air-duct portion 52. The valve member 5*b* is mounted inside the outer bushing 54. To do this, the valve member 5*b* includes a ring 59 that forms two valve seats 590 and 591. In addition, the valve member 5*b* includes a movable valve body 57*b* that forms an air-inlet valve 56*b*, and a check valve 58*b*. The valve 56*b* is for coming to bear selectively in leaktight manner against the seat 591, while the valve 58*b* is for coming to bear selectively in leaktight manner against the seat 590. The air-inlet valve 56*b* is in the form of a substantially frustoconical brim, while the check valve 58*b* is in the form of a slightly concave disk. The two valves 56*b* and 58*b* are interconnected via a connection rod 568, such that the two valves are secured to each other in movement. More precisely, the movable valve body 57*b* is movable along a single axis that is determined by the structure of the ring 59. Thus, only one valve at a time may bear in leaktight manner against its seat. In FIG. 4*a* it is the valve 56*b* that bears in leaktight manner against its seat 591, whereas in FIG. 4*b* it is the valve 58*b* that bears against its seat 590. The configuration in FIG. 4*a* corresponds to an elastic squeezing stage during which the air contained in the air expeller is put under pressure and flows through the connection sleeve 5. The path of the air is represented by the line that terminates in an arrow. It should thus be observed that the valve 56*b* is closed. FIG. 4*b* corresponds to an elastic relaxation stage during which outside air may penetrate into the air expeller through the open air-inlet passage 53, as a result of the valve 56*b* being lifted off its seat 591. The air-inlet passage 53 is in the form of a plurality of lateral ports formed by the ring 59. The lateral ports join together at a central passage in which the connection rod 57*b* extends.

In this second embodiment, it should be observed that the two valves 58*b* and 56*b* are secured to each other in movement. In theory, they could be made as a single part, but for practical-assembly reasons, they are made in two parts. The disk 58*b* acting as a valve may be molded integrally with the connection rod 57*b*. The air-inlet valve 56*b* may be made in the form of a cap that is formed with a brim serving as a valve. The cap may be mounted by being clamped on the free end of the connection rod 57*b*.

As described above, the operation of this dual-valve sleeve is identical to the operation of the first embodiment. The only difference is that the two valves are mechanically coupled to move together.

FIG. 5 shows a third embodiment for a connection sleeve 5. This sleeve also includes a base body 5*a* that is associated with a valve member 5*b*. The valve member 5*b* forms the air-inlet passage 53 and two valve seats 561 and 581. In this embodiment, the air-inlet valve 56*c* is formed by a ball that is adapted to bear selectively in leaktight manner against its seat 561. The check valve 58*c* is in the form of a disk for bearing selectively in leaktight manner against its seat 581. The operation of this dual-valve sleeve is identical to the operations of the above-described embodiments. However, in this embodiment, the two valves 56*c* and 58*c* are completely uncoupled, since there is no connection piece between them.

FIG. 6 shows a fourth embodiment for a connection sleeve 5 of the invention. This sleeve also includes a base body 5*a* that is associated with a valve member 5*b*. The valve member 5*b* forms a fastener section 57 that is terminated at one end by a valve seat 571, and at the other end by a flexible annular flange 56*d* that is adapted to bear selectively in leaktight manner against a seat 541 that is formed by the outer bushing 54 of the base body 5*a*. The air-inlet passage 53 is formed as in the first embodiment, i.e. between the outer bushing 54 and an inner bushing 54*b* inside which the valve member 5*b* is received. In this embodiment, the check valve 58*d* is in the form of a ball that bears selectively in leaktight manner against the seat 571. The air-inlet valve 56*d* is formed by the flexible annular flange. FIG. 6 is shown during an elastic relaxation stage, with outside air being sucked in through the air passage 53 until it reaches the inside of the expeller, with the air-inlet valve open.

In this embodiment, the seat 571 of the check valve is made integrally with the air-inlet valve 56*d*.

In all of the embodiments shown in the figures, the connection sleeve 5 includes both an air-inlet valve and a check valve. However, the connection sleeve could merely include a single valve, advantageously the air-inlet valve.

The invention thus provides a single-opening air expeller by using a connection sleeve that incorporates one or two valves.

The invention claimed is:

1. A fluid dispenser device for associating with a fluid reservoir so as to form a fluid dispenser, the device comprising:

a fluid dispenser orifice;

an air duct for air under pressure, said air duct including an upstream end and a downstream end that opens out in the proximity of the orifice;

an air expeller that is suitable for being subjected to elastic squeezing and relaxation stages, the air expeller being connected to the upstream end of the air duct so that, during elastic squeezing stages, it delivers a flow of air under pressure through the air duct until it reaches the orifice;

a fluid channel that is connected to the air duct in the proximity of its downstream end, the fluid in the channel being sucked up by the flow of air under pressure by the Venturi effect, in such a manner as to dispense a mixture of air and fluid through the dispenser orifice;

the air expeller has a single opening that is provided with a connection sleeve that defines at least one portion of the air duct, the sleeve further including an incoming-air passage that is provided with an air-inlet valve that is suitable for allowing outside air to enter into the air expeller during elastic relaxation stages, and for preventing air from leaving the air expeller through the passage during elastic squeezing stages, wherein the air expeller, when in the relaxation stage, has a cross-section that expands in a direction away from the upstream end of the air duct where the expeller is connected so as to define a shape configured to be squeezed between two opposing fingers in order to collapse the expeller; and a check valve interconnected with the air inlet valve by a connection rod, such that the two valves are secured to each other in movement.

2. A dispenser device according to claim 1, wherein the air-inlet valve co-operates with a valve seat in such a manner as to bear against its seat during elastic squeezing stages, the air-inlet valve being disposed in such a manner as to be urged against its seat by the flow of air under pressure generated during elastic squeezing stages.

3. A dispenser device according to claim 2, wherein the air-inlet valve is disposed at the center of the opening, and the flow of air under pressure that flows towards the air duct is directed to the air-inlet valve, the flow of air under pressure then passing around the valve.

4. A dispenser device according to claim 2, wherein the air-inlet valve is disposed around the air duct.

5. A dispenser device according to claim 1, wherein the connection sleeve also includes a check valve that prevents fluid from being sucked through the air duct and into the expeller during elastic relaxing stages.

6. A dispenser device according to claim 5, wherein the check valve co-operates with a valve seat in such a manner as to bear against its seat during elastic relaxation stages.

7. A dispenser device according to claim 5, wherein the check valve comprises a self-sealing slot that opens under the pressure of the flow of air generated during elastic squeezing stages, and that closes hermetically during elastic relaxation stages.

8. A dispenser device according to claim 7, wherein the air-inlet valve and the self-sealing slot are made as a single valve member, and are made out of a single material or by bi-injection of two different materials.

9. A dispenser device according to claim 8, wherein the valve member comprises a fastener bushing that is substantially rigid and that is provided at one end with a dome that is formed with the self-sealing slot, and at the other end with a flexible annular membrane that extends outwards and that serves as an air-inlet valve.

10. The dispenser device according to claim 1, wherein the air expeller is a flexible bulb.

11. The dispenser device according to claim 1, wherein the air expeller is formed from a flexible membrane and configured so that opposing inner sides of the flexible membrane are brought closer together during squeezing.

12. A fluid dispenser device for associating with a fluid reservoir so as to form a fluid dispenser, the device comprising:

a fluid dispenser orifice;

an air duct for air under pressure, said air duct including an upstream end and a downstream end that opens out in the proximity of the orifice;

an air expeller that is suitable for being subjected to elastic squeezing and relaxation stages, the air expeller being connected to the upstream end of the air duct so that, during elastic squeezing stages, it delivers a flow of air under pressure through the air duct until it reaches the orifice;

a fluid channel that is connected to the air duct in the proximity of its downstream end, the fluid in the channel being sucked up by the flow of air under pressure by the Venturi effect, in such a manner as to dispense a mixture of air and fluid through the dispenser orifice;

the air expeller has a single opening that is provided with a connection sleeve that defines at least one portion of the air duct, the sleeve further including an incoming-air passage that is provided with an air-inlet valve that is suitable for allowing outside air to enter into the air expeller during elastic relaxation stages, and for preventing air from leaving the air expeller through the passage during elastic squeezing stages, wherein the air expeller, when in the relaxation stage, has a cross-section that expands in a direction away from the upstream end of the air duct where the expeller is connected so as to define a shape configured to be squeezed between two opposing fingers in order to collapse the expeller, wherein the connection sleeve also includes a check valve that prevents fluid from being sucked through the air duct and into the expeller during elastic relaxing stages, wherein the check valve comprises a self-sealing slot that opens under the pressure of the flow of air generated during elastic squeezing stages, and that closes hermetically during elastic relaxation stages, and wherein the air-inlet valve and the self-sealing slot are made as a single valve member, and are made out of a single material or by bi-injection of two different materials.

* * * * *